US007614613B2

(12) United States Patent
Shield

(10) Patent No.: US 7,614,613 B2
(45) Date of Patent: Nov. 10, 2009

(54) METHOD OF OPERATING A COOLING FLUID SYSTEM

(75) Inventor: David B. Shield, Wadsworth, TX (US)

(73) Assignee: Equistar Chemicals, LP, Houston, TX (US)

( * ) Notice: Subject to any disclaimer, the term of this patent is extended or adjusted under 35 U.S.C. 154(b) by 420 days.

(21) Appl. No.: 11/800,321

(22) Filed: May 4, 2007

(65) Prior Publication Data

US 2008/0271790 A1 Nov. 6, 2008

(51) Int. Cl.
*B01F 3/04* (2006.01)

(52) U.S. Cl. ..... 261/26; 165/900; 261/36.1; 261/110; 261/151; 261/DIG. 11

(58) Field of Classification Search ..... 261/23.1, 261/26, 36.1, 109–111, 151, DIG. 11; 165/60, 165/301, 900
See application file for complete search history.

(56) References Cited

U.S. PATENT DOCUMENTS 1,874,020 A * 8/1932 Martin ..... 261/110
2,887,308 A * 5/1959 Sala ..... 261/36.1
3,322,409 A * 5/1967 Reed ..... 261/71
3,782,453 A * 1/1974 Cates et al. ..... 165/138
3,820,353 A * 6/1974 Shiraishi et al. ..... 62/305
3,917,764 A * 11/1975 Phelps ..... 261/111
4,003,970 A * 1/1977 Vodicka ..... 261/159
4,007,241 A * 2/1977 Phelps ..... 261/149
4,032,604 A * 6/1977 Parkinson et al. ..... 261/111
4,094,937 A * 6/1978 Bodick et al. ..... 261/111
4,190,102 A * 2/1980 Gerz ..... 165/113
4,236,574 A * 12/1980 Bosne ..... 165/67
4,362,628 A * 12/1982 Kennedy et al. ..... 210/712
4,474,027 A * 10/1984 Kaya et al. ..... 62/171
4,579,692 A * 4/1986 Bugler et al. ..... 261/111
4,592,878 A * 6/1986 Scrivnor ..... 261/111
4,662,902 A * 5/1987 Meyer-Pittroff ..... 96/53
4,964,977 A * 10/1990 Komiya et al. ..... 261/130
5,339,854 A * 8/1994 Leith ..... 137/2
6,149,136 A * 11/2000 Armstrong et al. ..... 261/19
6,598,862 B2 * 7/2003 Merrill et al. ..... 261/128
7,510,174 B2 * 3/2009 Kammerzell ..... 261/153
2005/0104237 A1 * 5/2005 Boxsell ..... 261/110

FOREIGN PATENT DOCUMENTS

JP 5-87468 A * 4/1993

* cited by examiner

*Primary Examiner*—Richard L Chiesa
(74) *Attorney, Agent, or Firm*—Roderick W. MacDonald

(57) ABSTRACT

In a gravity fed cooling tower liquid return system having a common header with a plurality of valved sub-headers, a distributive control system, risers on the sub-headers, and sensor/transmitters on the risers, some of the sensor/transmitters controlling the valves on their respective sub-headers, sensing the liquid level in each of the sub-headers, comparing the sensed liquid levels in the distributive control system, and controlling the liquid levels in the sub-headers in response to the sensed liquid levels.

6 Claims, 6 Drawing Sheets

METHOD OF OPERATING A COOLING FLUID SYSTEM

BACKGROUND OF THE INVENTION

1. Field of the Invention

This invention relates to the operation of a cooling fluid system for a production plant wherein a gravity-drained cooling fluid return header system is employed to feed a cooling tower complex.

More particularly, this invention relates to the operation of a gravity drained cooling fluid return system for a multi-cell cooling tower complex which return system provides a uniform flow of hot cooling fluid to each cooling cell of that complex.

This invention is especially applicable to cooling fluid return systems that employ a single return header, which header feeds multiple return sub-headers wherein each sub-header feeds returned hot cooling fluid to an individual cooling cell in a multi-cell cooling tower complex.

2. Description of the Prior Art

For sake of clarity and brevity, this invention will be described in relation to a polyethylene production plant that uses an exothermic process for forming polyethylene in water cooled reactors. Accordingly, this plant uses liquid water (hereafter "water") as a cooling fluid for the reactor(s) in the plant, and a cooling tower complex consisting of five individual cooling cells that operate synchronously. However, this invention is not limited to such a production plant, cooling tower system, or water as a cooling fluid.

In a cooling tower system that employs a plurality of cooling cells that are each fed by a gravity-drained sub-header that is in fluid communication with a closed end (blind), common cooling water return header pipe (conduit), the challenge is to obtain uniform water flow through each sub-header take-off pipe so that the heated return water is evenly distributed among the various individual cooling cells.

Cooling of the polymer producing reactors in the plant can be a limiting factor for the production rate of those reactors, particularly in the warmer months of the year. The goal is to supply cooling water to the plant that is consistently as close as possible to the ambient temperature of the plant, hence the drive for even distribution of hot cooling water to the cooling cells.

With even distribution of returned, hot cooling water between all the cooling cells of the cooling tower complex, maximum ambient cooling of the return water is achieved, which, in turn, helps maximize the polymer production rate of the plant as a whole.

This even distribution of returned cooling water to all the cells in the cooling tower complex is particularly challenging in a gravity-fed return system when the take-off points for the sub-headers from the common header are at different locations along the vertical height of that header. This invention meets that challenge.

As will be seen in greater detail hereinafter, balancing gravity-fed water return flows between multiple sub-headers from a common header is readily achieved by this invention as a matter of routine in a timely manner.

Heretofore, this return water balancing act was attempted by employing a manually operated butterfly valve mounted in each sub-header. Each such valve was manually opened or closed in an effort to get uniform flow through each sub-header. Approximate uniform water flow through each sub-header and cooling cell was attempted to be achieved by simple visual observation by the person operating the valves of the volume of water falling through each of the cells, the operator manually opening and closing individual valves until approximately even volumes of water were observed by the operator to be flowing through each of the cells.

In reality, this prior art process, because of the hysteresis effect of flowing water as described in greater detail hereinafter, this goal was impossible to achieve in a reasonable period of time, and extremely difficult to achieve even if time was of no consequence, which is never the case in a commercial production plant. This was so even if the return water was taken off from the common header at the same height along that header. When the return water was taken off from different locations across the height of the common header, the problem of obtaining even flow of return water to all sub-headers was made immeasurably more difficult because it was possible, even probable, that all or a major portion of the return water (see FIG. 4 hereinafter) would be removed from the header by way of less than all of the sub-headers, thereby starving at least one sub-header and its associated cooling cell of return water flow altogether. This situation puts more return water to be cooled through less than all the cooling cells available in the complex, and prevents the cooling tower complex from achieving its goal of cooling the return water to as close as possible to the ambient temperature surrounding that complex.

One method for solving the even distribution of return water through the sub-headers could arguably be measuring the actual volume of water flowing in each sub-header, but this would entail the use of a complicated system of fluid flow measuring equipment that would be expensive to install and maintain. This invention employs less expensive equipment involving easier to detect liquid levels, as opposed to measuring actual liquid flow volumes, in each sub-header, and then using this liquid level data as a measure of uniform water flow in each sub-header and its associated cooling cell.

SUMMARY OF THE INVENTION

This invention provides a simpler, more cost effective, and more reliable method for achieving uniform return water flow across multiple, individual sub-headers by relying on the measurement of water levels in the sub-headers, and not actual water flow volume measurements.

This invention works equally as well even with differing take-off point elevations on the common header.

This invention also provides significantly more accurate return water control through multiple sub-headers in a time period more acceptable in a commercial production plant than that achievable by way of the prior art practice of manually operating individual sub-header control valves using visually observed relative amounts of return water actually flowing through individual cooling cells.

DETAILED DESCRIPTION OF THE INVENTION

This invention is based, in part, on the inventive concept that cooling water return flows to a cooling tower complex are essentially balanced when the sub-headers are each partially liquid full, thereby leaving a vapor phase above the liquid surface in each sub-header.

Further to the inventive concepts of this invention, since the sub-header piping and cooling tower cell construction are similar, the liquid levels in the sub-headers are approximately the same when the return water flows to the cells are balanced. That is to say the flooded (liquid water carrying) cross-sectional area in all the sub-headers is approximately the same, i.e., balanced, as a measure of water flow in the sub-headers without measuring the amount (volume) of water actually flowing in any of the sub-headers.

Figure 1:
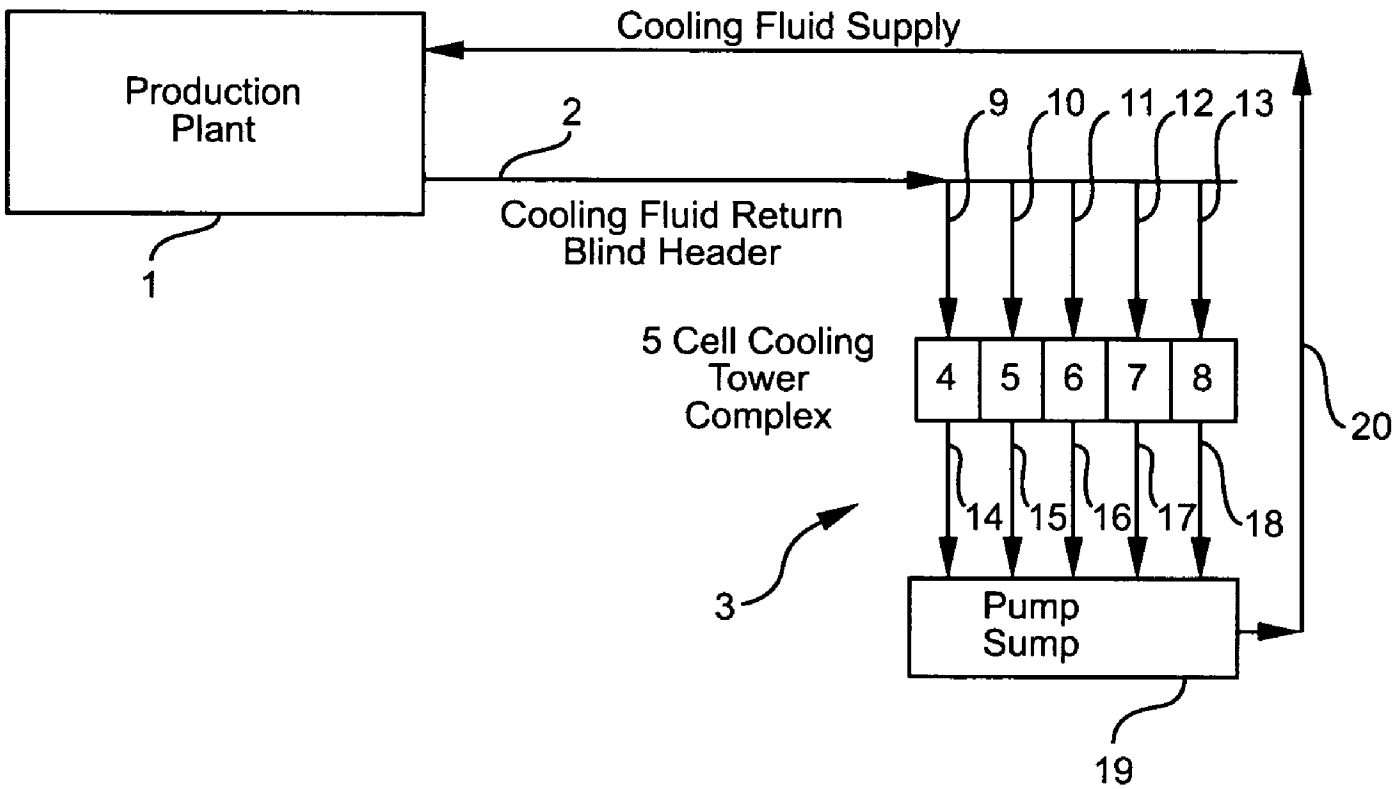
FIG. 1 (Prior Art)
FIG. 1 shows a schematic of a typical production plant and its association with a cooling tower complex.

FIG. 1 shows a production plant 1 that carries a common header conduit 2 that returns heated cooling water to a cooling tower complex 3. Complex 3 is composed of 5 contiguous cooling cells 4 through 8, inclusive, which are in fluid communication with one another only by way of their common sump 19 and through their respective inlet sub-headers 9 through 13, inclusive, through common header 2.

Cooled water passes from each of cells 4 through 8 by way of individual streams 14 through 18, inclusive, into a common sump 19 from which the cooled water is pumped into conduit 20 for passage to plant 1 again to cool the reactors therein.

Figure 2:
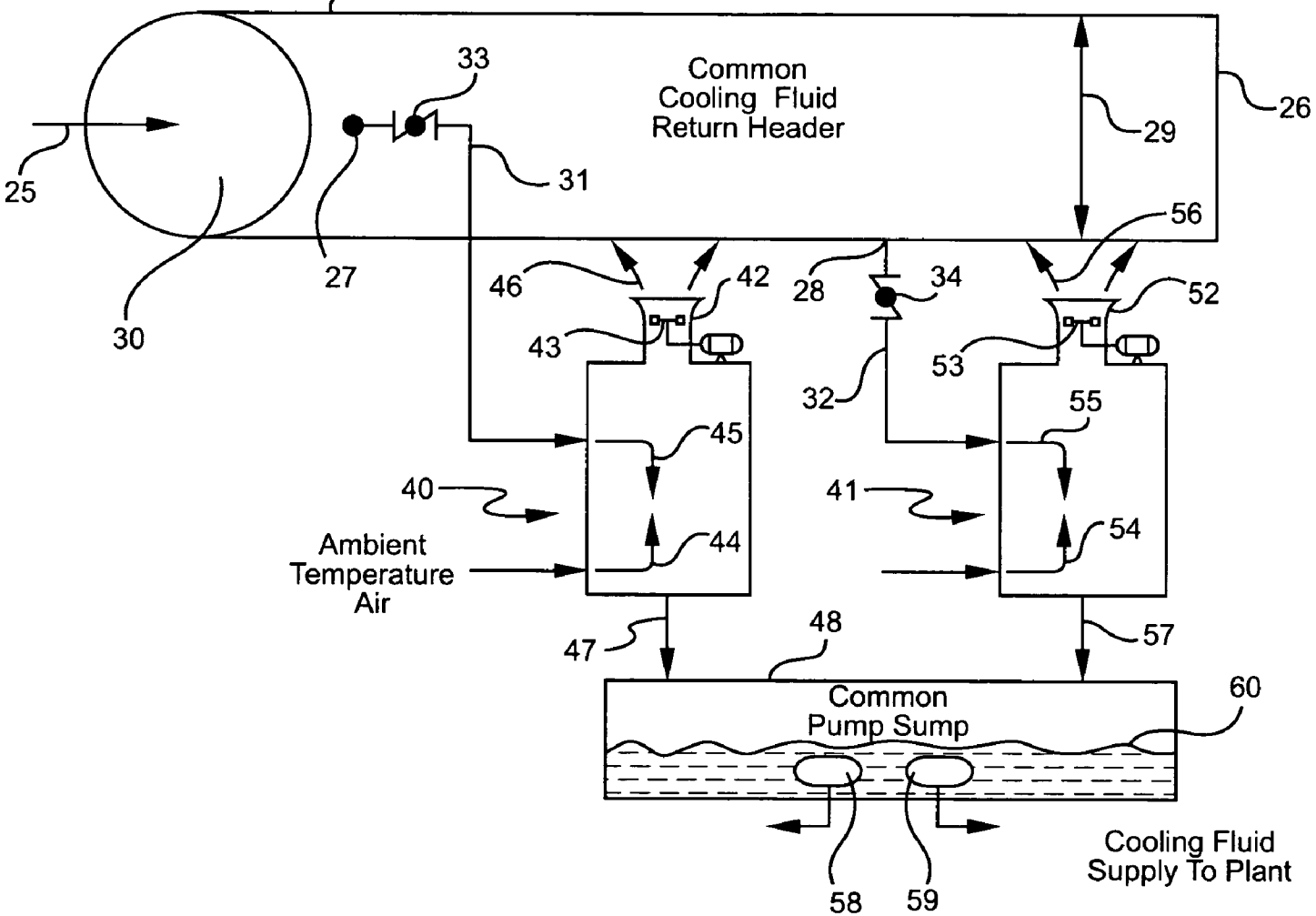
FIG. 2 (Prior Art)
FIG. 2 shows a typical relationship of a common header with a cooling tower complex consisting of two cooling cells.

FIG. 2 shows header 2 to contain return water 25 gravity flowing therein in the direction shown by the arrow toward closed (blind) end 26 of header 2. Header 2, in this Figure, has two take-off points 27 and 28 that are at different locations with respect to the vertical height 29 of header 2, point 27 being half way up height 29, and point 28 being on the bottom of header 2. Pipes 31 and 32 are in fluid communication with the interior 30 of header 2 through points 27 and 28, respectively. Each of pipes 31 and 32 carry a butterfly valve 33 and 34. Each of valves 33 and 34 is chain wheel driven so that an operator can independently, manually open and/or close the valves in any desired combination of partially open and partially closed settings, as well as fully open and fully closed. Hot return water gravity flows from inside header 2 into sub-headers 31 and 32.

In this Figure the cooling tower complex is shown to consist of two fluid flow independent cooling cells 40 and 41. Cell 40 carries an outlet 42 which contains a motor driven fan 43 that pulls ambient air 44 into a lower region of cell 40, and upwardly inside cell 40 in counter current flow with incoming, downwardly flowing, gravity fed, hot return water 45. This way water 44 is cooled towards the ambient temperature of air 44. Heated air 46 leaves cell 40 by way of outlet 42, while cooled return water flows by way of stream 47 into common cooled water sump 48.

Similarly, cell 41 contains an outlet 52 that contains motor driven fan 53 to pull outside air 54 through the interior of cell 41 against downwardly falling hot return water 55 to cool same essentially to the ambient temperature surrounding the outside of cell 41. Hot air 56 leaves cell 41 by way of outlet 52, and cooled water leaves the bottom of cell 41 as stream 57 for collection in sump 48.

Cooled water 60 remains in sump 48 until resent to plant 1 of FIG. 1 for reuse as cooling water. In FIG. 2, two pumps 58 and 59 are shown in sump 48. This is what the situation would be if there were two separate reactors in plant 1 so that each of pumps 58 and 59 would supply cooling water to separate reactor lines in plant 1.

In operation an operator would visually observe the relative amounts of water in streams 47 and 57, and, if they were uneven, attempt to even them up by manually adjusting valves 33 and 34. As shown hereinafter, this approach did not work well at all due to the hysteresis characteristics of flowing water.

Figure 3:
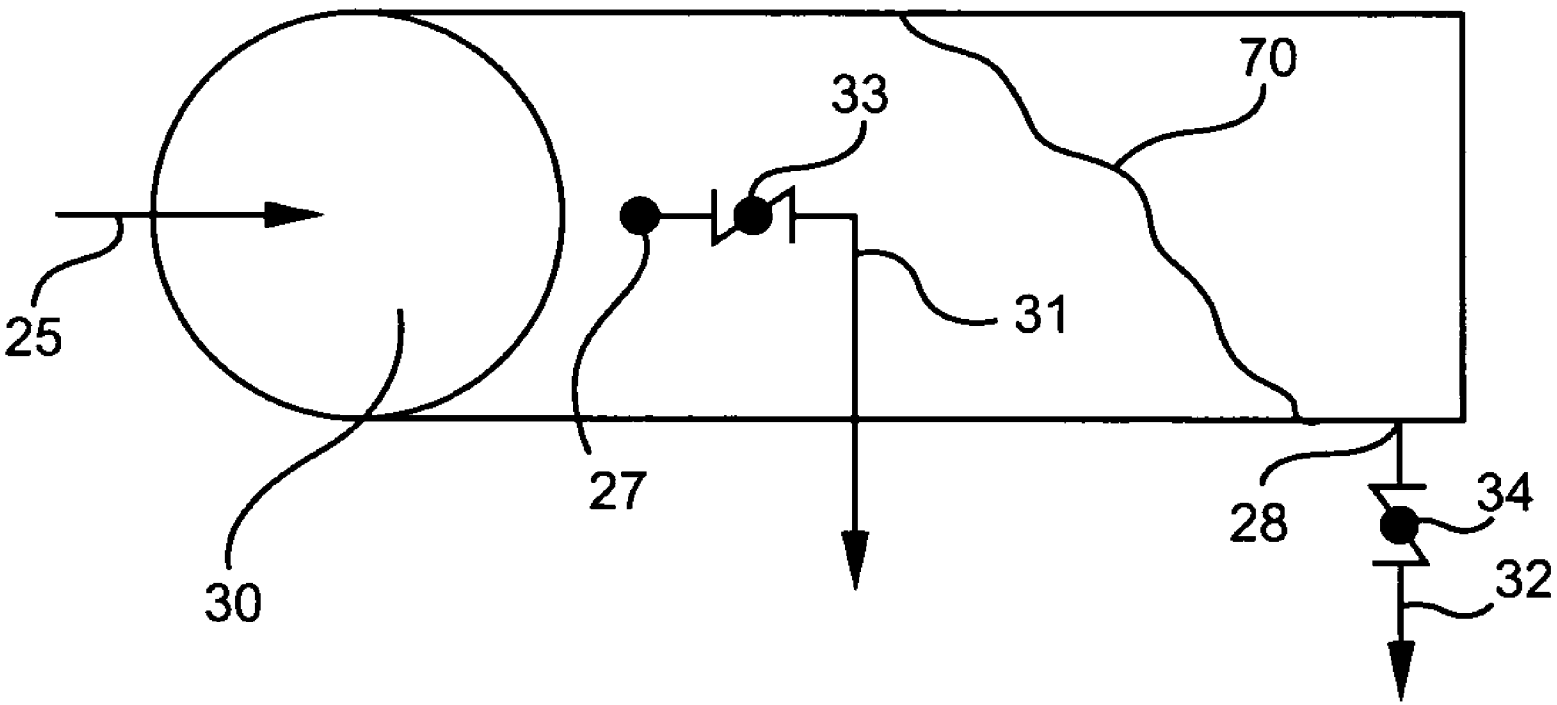
FIG. 3 (Prior Art)
FIG. 3 shows the common header of FIG. 2 when one of the sub-headers is starved of return water.

FIG. 3 shows the apparatus of FIG. 2 containing returned, hot water 25 to have an end surface 70 so that water 25 does not reach take-off point 28, and cell 41 thus starved of hot water to cool. This means that all the returned, hot water 25 is flowing through cell 40, thereby overloading cell 40 and not cooling stream 47 (FIG. 2) to a temperature as close to the ambient air temperature as would be achieved were cell 42 receiving an amount of hot water essentially equal to that of cell 41, i.e., water flow through cell 42 was balanced with water flow through cell 42.

Figure 4:
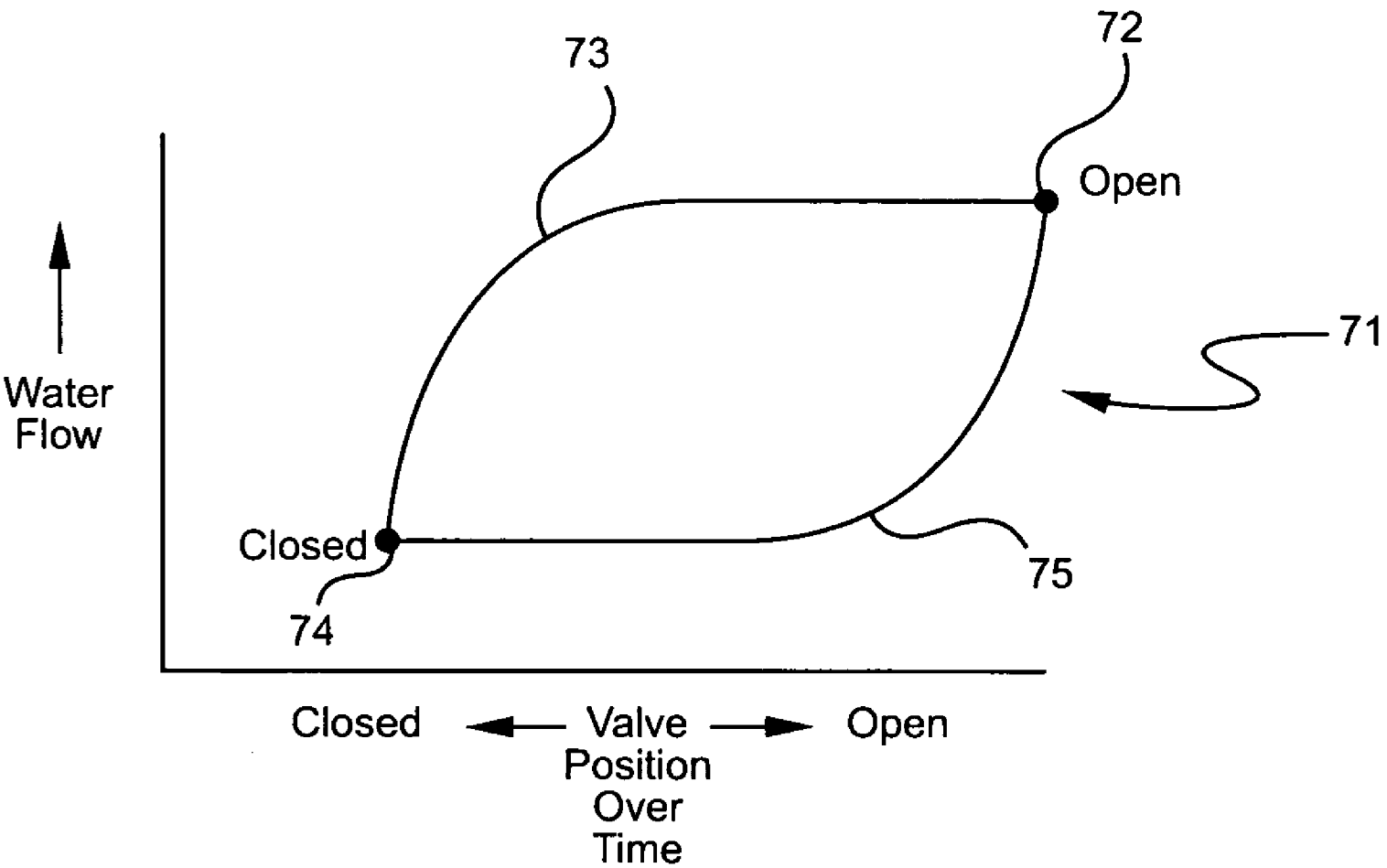
FIG. 4 (Prior Art)
FIG. 4 shows a hysteresis curve for flowing water in relation to a valve and various stages of opening for that valve.

Attempting to correct this imbalance of water flow out of take-off points 27 and 28 does not work with simple manual operation of chain wheel driven valves 33 and 34. This is demonstrated in FIG. 4 which shows a generic hysteresis curve 71 for water flowing through a valve and the response of the flowing water to opening or closing of the valve through which the water is flowing. This curve shows that if a valve is initially fully open, point 72, and is gradually closed, the reduction of the flow of water is very gradual for a time period until a break point 73 is reached, at which time the reduction in water flow increases extremely rapidly down to the point where there is no flow at point 74 when the valve is fully closed. Similar response is experienced when opening a valve to water flow, the increase in water flow after partially opening the valve being very gradual until a break point 75 is reached after which the increase in flow of water increases very dramatically.

Assuming the extreme imbalance between cells 40 and 41 as shown in FIG. 3 occurs, a not unlikely situation in a gravity fed system, an operator visually observing that no water was flowing through cell 41 because there was no stream 57, the operator would manually close down somewhat on valve 33 to try to push water level 70 toward outlet 28. Because of the hysteresis curve of FIG. 4, the operator would close valve 33 and then wait to see if a stream 57 starts, but he would not see a stream 57 start-up because the flow is very gradually slowed as the operator moves toward point 73. The operator would repeat this step a number of times over a short period of time because the pressure in an operating plant is to get things corrected in as short a time as possible. This would lead the operator to close the valve beyond break point 73 at which time stream 47 would be dramatically reduced and stream 57 would be too large. The operator would then have to go back to manually adjusting not just one valve 33, but also valve 34 to try get balance back in the other direction between streams 47 and 57. When trying to adjust two valves, one more open and one more closed, the operator risks passing both break points 73 and 75. Over a very long time of continued adjustment, the operator may ultimately reach some sort of balance for streams 47 and 57, but this is by no means assured, and, even if accomplished, will take far more time than is tolerable in an operating plant where the degree of cooling on the returned water has a direct effect on the output of the plant.

Figure 5:
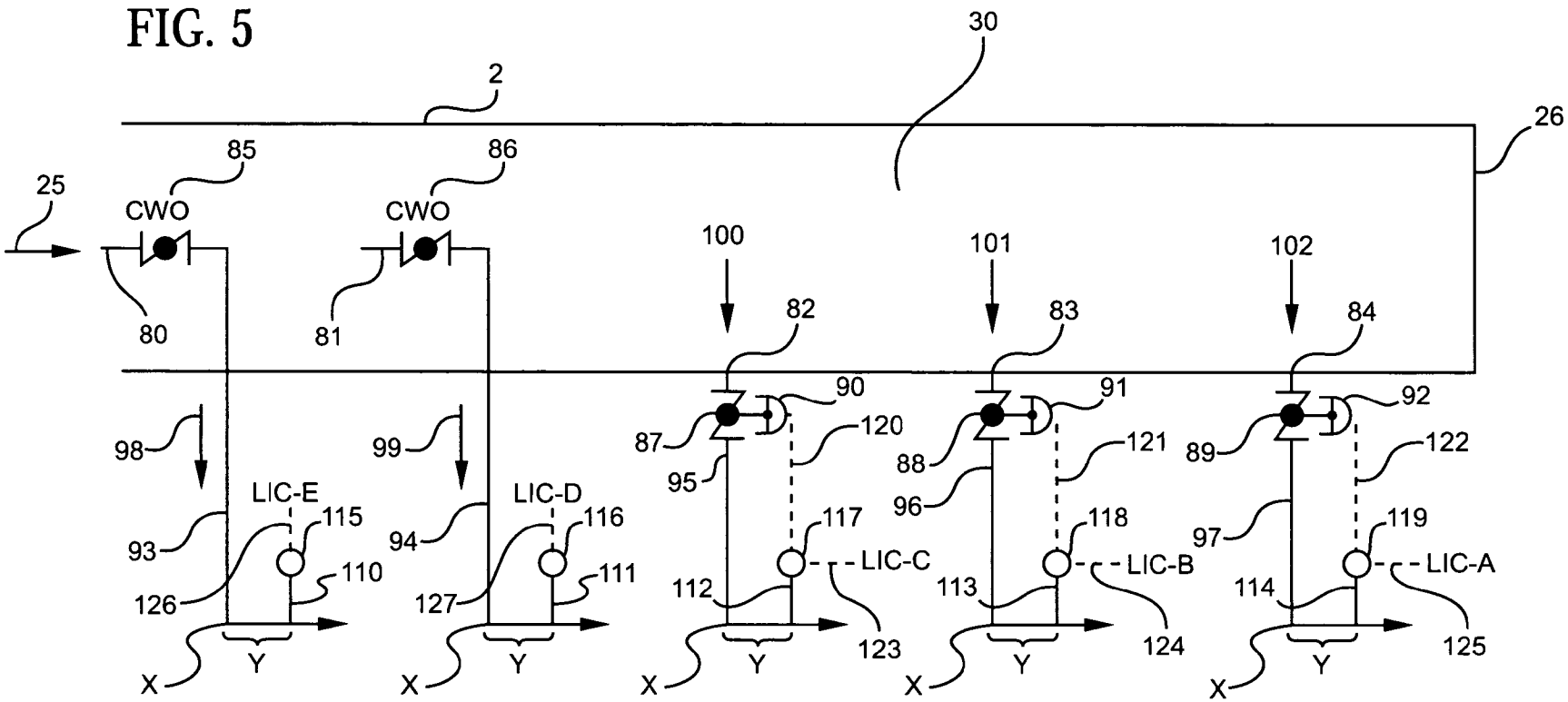
FIG. 5 shows a header/sub-header installation embodying this invention.

FIG. 5 shows one embodiment of this invention wherein there are five take-off points 80 through 84, inclusive, from header 2. Pursuant to this invention at least some, including all, of the prior art chain wheel operated (cwo) valves are replaced. In the embodiment of this Figure, mid-height take-off cwo valves 85 and 86 are left as is, while lower level (e.g., bottom) take-off valves 87 through 89, inclusive, are fitted with valve actuators 90 through 92, inclusive. Valve actuators are well known in the art and commercially available, suitable such rotary actuators being any commercially available degree turn pneumatic actuator fabricated for use with a butterfly valve. Suitable rotary actuators are the Kinetrol Model 16 paddle actuator. Well known rack and pinon or single piston actuators can also be used.

Sub-headers 93 through 97, inclusive, carry gravity fed water sub-streams 98 through 102, inclusive. Preferably, all of sub-streams 98 through 102 are balanced. Having seen with respect to FIGS. 3 and 4 how difficult the hysteresis curve of Figure makes balancing streams 47 and 57, balancing streams 98 through 102 is practically impossible for an operator to achieve even when given an unlimited time in which to accomplish the balancing act.

Remembering that the system of FIG. 5 is gravity fed, ideally sub-headers 93 through 97 are approximately of the same diameters, elevations, and slopes, although this is not required to achieve most of the benefits of this invention. The sum of the cross-sectional areas of sub-headers 95 through 97 can be less than the cross-sectional area of header 2.

After a common point "X" on each of sub-headers 93-97 and at an essentially common distance "Y" downstream from point X, upstanding, hollow nozzles 110 through 114, inclusive, are placed into fluid communication with the individual interiors of sub-headers 93 through 97 so that, by way of the interiors of nozzles 110 through 114, the interiors of sub-headers 93-97 can be viewed. Point X could be, for example, the last change of pipe direction for each sub-header before there is a straight shot to the cooling cell to which the sub-header is connected, e.g., an elbow turn, and distance Y would be a fixed number of feet downstream from that elbow.

Nozzles 110 through 114 are located so that when looking through the hollow interior of the nozzle into the interior of the sub-header, the vapor space inside those sub-headers that exists over the liquid water level in each sub-header is first encountered, after (through) which vapor space the level of the water (top surface of the liquid water) inside sub-headers 93 through 97 can be seen or otherwise sensed.

Surmounted on each of nozzles 110 through 114 so that it can see through the nozzle interior and see or otherwise sense the water level inside each sub-header is a sensor (detector) 115 through 119, inclusive, and transmit a signal representative of the sensed level to a central control room. Water level sensor/transmitter devices are well known in the art and commercially available in a wide variety of technologies. Suitable such devices could be a radar unit, a capacitance probe, a differential pressure cell, or an ultrasonic unit. One such suitable device is the Mobrey MSP 2 made available by Emerson Process Management.

Units 117 through 119 are electrically connected by way of lines 120 through 122, respectively, to actuators 90 through 92 so that the actuators can be controlled to open or close their respective valves to any extent desired in the 90 degree movement of butterfly valves 87 through 89. Units 117 through 119 are also electrically connected by way of lines 123 through 125, inclusive, to a conventional liquid level indicator control (LIC) in an equally conventional Distributed Control System (DCS) in the central control room. DCS systems are well known in the art and commercially available from control system suppliers such as Honeywell and Fisher Controls.

Units 115 and 116 are also electrically connected by way of lines 126 and 127 to the same DCS as are lines 123 through 125 so that in the DCS LIC liquid level signals A, B, C, D, and E are received. Accordingly, in the central control room, the liquid water levels in each of sub-headers 93 through 97 can be read, and appropriate action through the control of valves 87 through 92 by way of actuators 90 through 92 taken by the DCS computer to achieve a balance of water flows through all sub-headers 93 through 97 thereby achieving optimal use of all five cooling cells to which sub-headers 93 through 97 are connected, as shown for two such cells in FIG. 2. If desired the computer in the DCS can be used to average the LIC-D and LIC-E signals, and the LIC-A, B, and C levels adjusted accordingly through operation of actuators 90 through 92 and valves 87 through 92 to balance this average of the LIC-D and E levels. Put another way, the flooded cross-sectional areas in sub-headers 93 through 97 will be balanced by the computer in the DCS using the combination of water flow levels sensed in those sub-headers by units 115 through 119 and the control of valves 87 through 89 by way of actuators 90 through 92.

Figure 6:
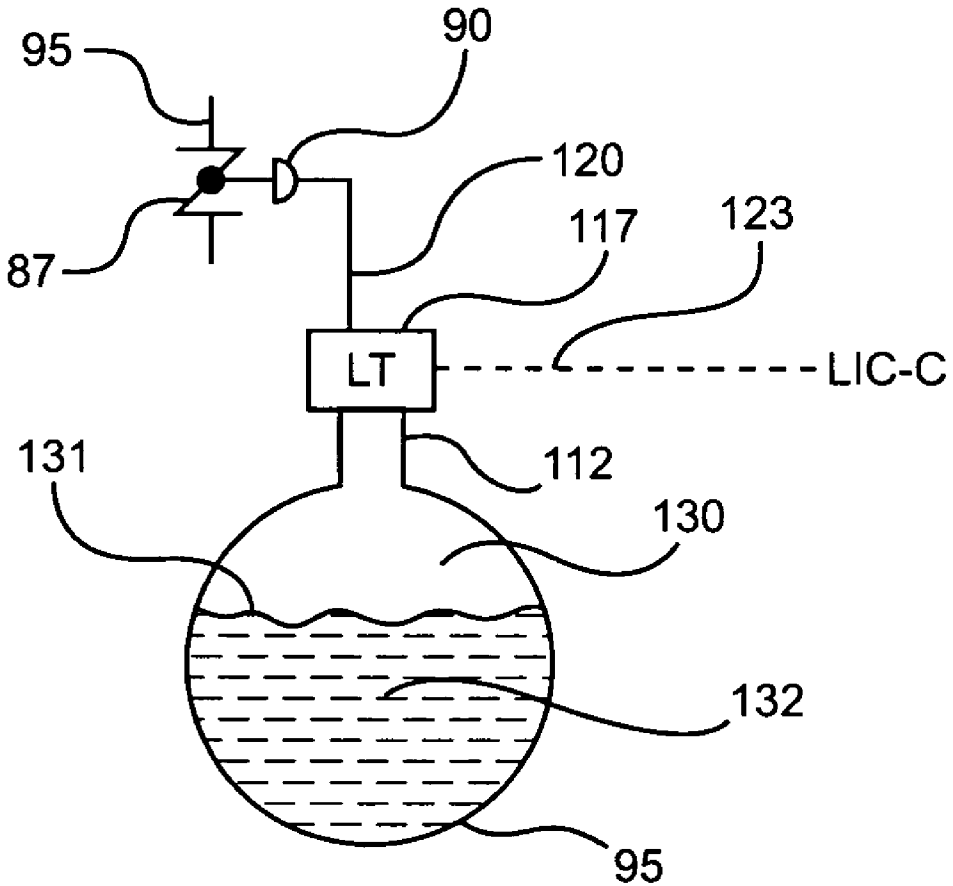
FIG. 6 shows a cross-section of a sub-header installation within this invention.

FIG. 6 shows a water carrying cross-sectional interior area of a typical sub-header 95 downstream of point X (see FIG. 5) with its water level sensing/transmitting unit 117 mounted on top of pipe 112 so that unit 117 first sees vapor space 130 that is disposed above liquid water level 131. LT unit 117 senses, wherein inner volume 132 liquid level 131 resides, and sends a signal representative of this level to the LIC-C control in the DCS by way of line 123. If the DCS computer sees that the sensed liquid level 131 is out of balance with the other sensed liquid levels LIC-A, B, D, and/or E, the DCS computer can, by way of lines 123 and 120, manipulate actuator 90 to open or close valve 87 to bring liquid level 131 into balance with the other liquid levels sensed and transmitted to the DCS. The computer in the DCS can make an infinite number of changes of valve 87 in a short time period, and do so twenty-four hours a day, seven days a week, until a proper balance is achieved, something a human operator or series of operators could not accomplish in the same time period. The DCS computer is not put off at all by having to control a number of valves at the same time in this fashion whereas an operator is. Thus, this invention provides superior balancing of common return flow water among a plurality of cooling cells compared to that of the prior art.

I claim:

1. In a gravity fed cooling tower liquid return system wherein said cooling tower system contains a plurality of cooling cells, each said cell being fed heated return liquid by way of an individual sub-header, each said sub-header being in fluid communication with a common header having a vertical height, at least one but not all of said sub-headers being connected to said header at a location higher on said vertical height of said header than the remaining at least one lower sub-header, said at least one higher sub-header carrying manually controlled valves, each said sub-header having a liquid carrying cross-sectional interior area, the improvement comprising providing a distributed control system and an open riser on each of said sub-headers, said risers being in fluid communication with said interior areas of their respective sub-headers, each said riser carrying a liquid level detector/transmitter for determining the height of the liquid level in each said sub-header and transmitting same to said distributed control system, each said at least one lower sub-header carrying an actuator operated valve, each of said liquid level detector/transmitters associated with said at least one lower sub-header being in operative communication with its corresponding actuator valve on its sub-header, sensing said liquid level in said interior of each of said sub-headers, in said distributed control system comparing said liquid levels in said at least one higher sub-header with said liquid levels in said at least one lower sub-header, and controlling by way of said at least one lower sub-header and associated actuator valve said liquid levels in said at least one lower sub-header to be approximately the same as said liquid level in said at least one higher sub-header, whereby said liquid carrying cross-sectional area in said sub-headers is essentially balanced.

2. The system of claim 1 wherein there are at least two higher sub-headers and at least two lower sub-headers.

3. The system of claim 1 wherein said sub-headers have essentially the same cross-sectional area, elevation, and slope.

4. The system of claim 1 wherein said liquid levels in said higher sub-headers are averaged in said distributed control system, and said at least one lower sub-header liquid level is controlled by its associated actuator valve to approximate one of 1) a single higher sub-header liquid level or 2) an average of more than one higher sub-header liquid level.

5. The system of claim 1 wherein a nozzle is fixed to an upper portion of its associated sub-header so that said nozzle is above any liquid level in that sub-header.

6. The system of claim 1 wherein there are more than one lower sub-header and the sum of the cross-sectional areas of said lower sub-headers is greater than the total cross-sectional area of said header.

* * * * *